United States Patent [19]

Grindle et al.

[11] 4,254,456

[45] Mar. 3, 1981

[54] LUMINAIRE FOR ASSEMBLY LINE

[75] Inventors: James L. Grindle; Marcus P. Hogue, both of Hendersonville, N.C.

[73] Assignee: General Electric Company, Schenectady, N.Y.

[21] Appl. No.: 125,146

[22] Filed: Feb. 27, 1980

[51] Int. Cl.[3] ..... F21V 7/09

[52] U.S. Cl. ..... 362/300

[58] Field of Search ..... 362/296, 297, 298, 299, 362/300, 302, 303, 346, 347, 304, 305

[56] References Cited

U.S. PATENT DOCUMENTS

| | | | |
|---|---|---|---|
| 1,577,352 | 3/1926 | Caughlan | 362/347 |
| 2,143,673 | 1/1939 | Baumgartner . | |
| 2,198,014 | 4/1940 | Ott | 362/303 |
| 3,443,086 | 5/1969 | Rikis | 362/346 |
| 3,749,906 | 7/1973 | Thiry | 362/303 |
| 3,796,886 | 3/1974 | Freeman | 362/303 |
| 4,037,096 | 7/1977 | Brendgord et al. | 362/298 |

FOREIGN PATENT DOCUMENTS

| | | | |
|---|---|---|---|
| 651753 | 10/1928 | France | 362/298 |
| 711165 | 6/1931 | France | 362/298 |
| 802883 | 6/1936 | France | 362/298 |

*Primary Examiner*—L. T. Hix
*Assistant Examiner*—Alan Mathews
*Attorney, Agent, or Firm*—Sidney Greenberg; Lawrence R. Kempton; Philip L. Schlamp

[57] ABSTRACT

Luminaire with high intensity gaseous discharge lamp for illuminating a work area such as an automobile assembly line. The lamp is arranged between a concave main reflector and an auxiliary reflector facing the central portion of the main reflector. The arrangement is such that it provides adequate light control to efficiently illuminate the work area while shielding the lamp from direct view of the worker and reducing shadows on the work area due to the worker being positioned between the work and the luminaire.

7 Claims, 3 Drawing Figures

LUMINAIRE FOR ASSEMBLY LINE

The present invention relates to luminaires, and more particularly to luminaires suitable for illuminating the work area of automobile assembly lines.

It is an object of the invention to provide an improved luminaire of the above type.

It is a particular object of the invention to provide a luminaire of the above type having a high intensity gaseous discharge lamp which efficiently and uniformly illuminates the work area while avoiding glare in the eyes of a worker.

Another object of the invention is to provide a luminaire of the above type which may be mounted at relatively low heights and which substantially reduces the shadows formed by a person or object interposed between the luminaire and the illuminated area.

Other objects and advantages will become apparent from the following description and the appended claims.

With the above objects in view, the present invention in one of its aspects relates to a luminaire comprising, in combination, a housing having a front opening, a concave main reflector mounted within said housing facing said front opening, said main reflector comprising a pair of curved sections arranged on opposite sides of a vertical median plane adjacent thereto, an auxiliary reflector comprising a pair of curved sections arranged on opposite sides of said vertical median plane spaced forwardly from and respectively facing said pair of curved sections of said main reflector, and means for mounting a light source substantially in said plane in the space between said pairs of curved reflector sections, so that light rays from the light source incident on said auxiliary reflector are redirected thereby to said curved sections of said main reflector for reflection therefrom outwardly through said front housing opening on opposite sides of said vertical median plane.

The invention will be better understood from the following description taken in conjunction with the accompanying drawings, in which.

Figure 1:
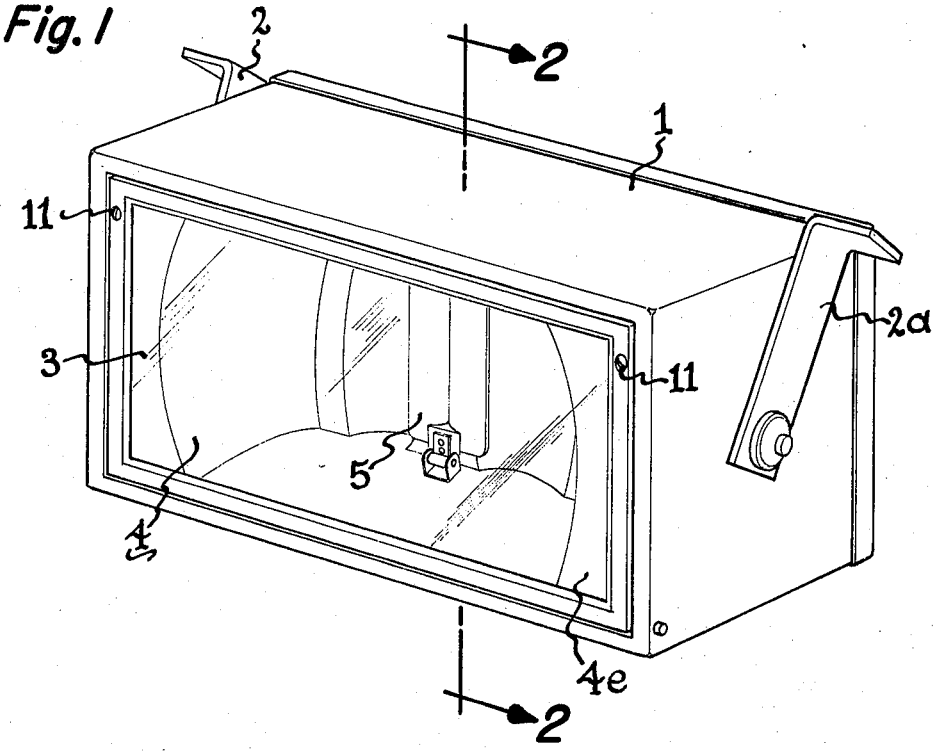
FIG. 1 is a perspective view of a luminaire in which the invention is embodied.
Figure 2:
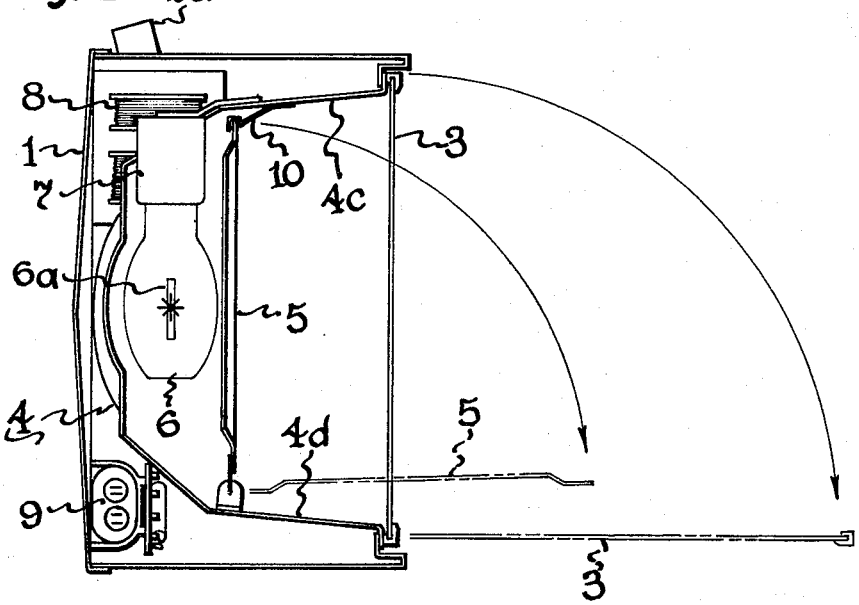
FIG. 2 is a sectional view of the luminaire as taken along the line 2—2 of FIG. 1.

Referring now to the drawings, and particularly to FIGS. 1 and 2, there is shown a luminaire suitable for mounting adjacent a work area such as an automobile assembly line, the luminaire comprising a housing 1 defining an interior chamber and having a front opening closed by a transparent closure 3. The luminaire may be mounted on a suitable support (not shown) by means of flanged brackets 2 and 2*a* pivotally attached to the side walls of housing 1 as shown, whereby the luminaire may be aimed at the desired work area by adjustment about the pivot axis and locked in the adjusted position.

Figure 3:
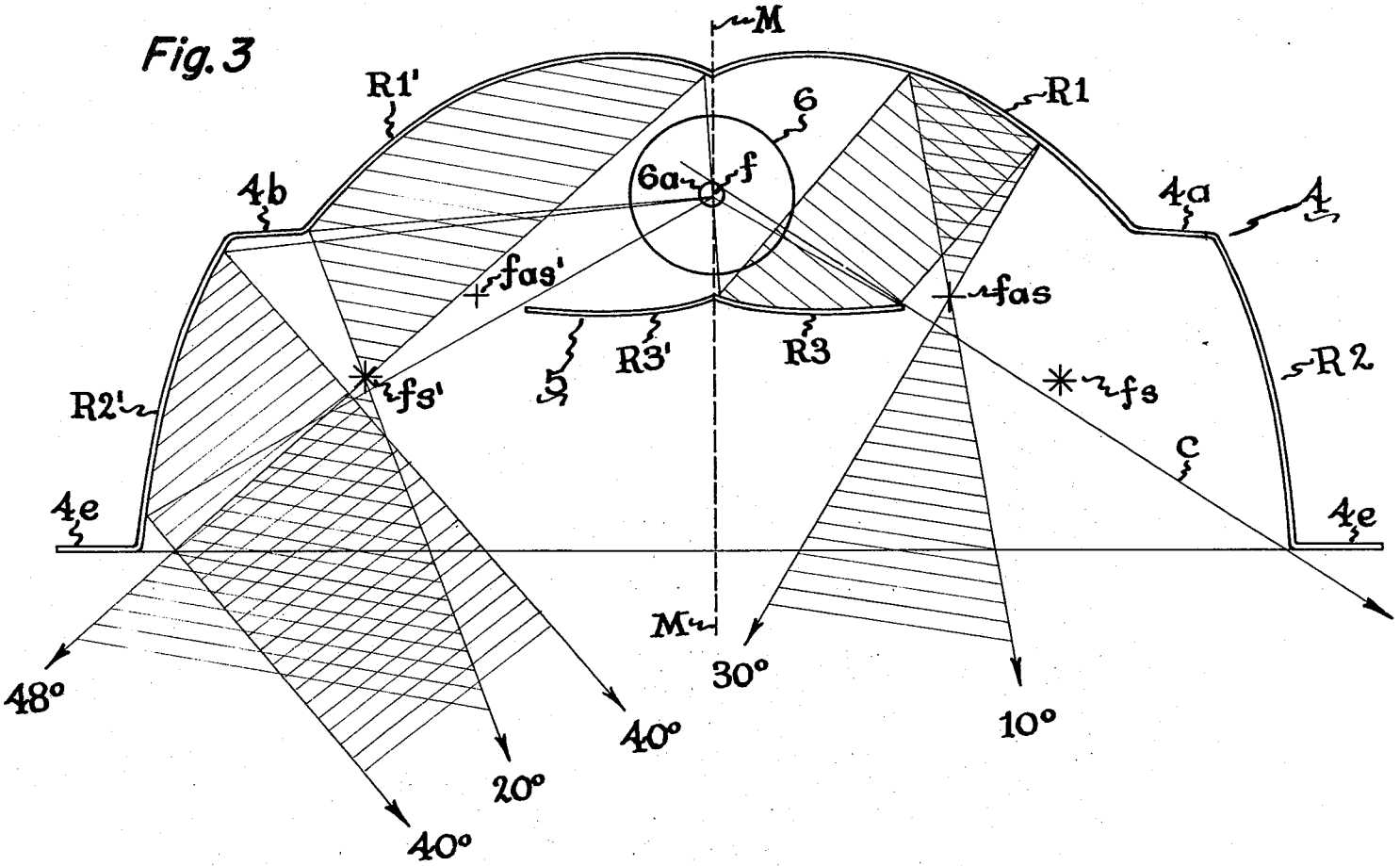
FIG. 3 is a diagrammatic view of the optical system of the FIG. 1 luminaire showing the reflection of light rays emanating from the lamp.

Mounted within housing 1 facing the front opening is a concave main reflector 4 having the configuration in horizontal section as shown in FIG. 3. Arranged spaced in front of main reflector 4 is auxiliary reflector 5 having a rearwardly facing reflective surface and hingedly secured at its lower end to the bottom wall of reflector 4. Mounted in the space between main reflector 4 and auxiliary reflector 5 is lamp 6, which is typically an elongated high intensity gaseous discharge lamp such as a mercury vapor or sodium vapor lamp. In the illustrated embodiment, lamp 6 is removably mounted at its upper end in socket 7 which is suitably secured by a bracket to the top of main reflector 4 as shown, the lamp extending downwardly along a vertical axis from the socket into the space between main reflector 4 and auxiliary reflector 5 (see FIG. 2). Ballast transformer 8 and capacitor 9 for electrically operating lamp 6 are suitably mounted in housing 1 behind main reflector 4. Transparent closure 3 is hingedly secured to the bottom edge of housing 1 so as to be movable from a closed position covering the front opening of the housing to an open position away from the front opening, as seen in FIG. 2. Closure 3 is secured in its closed position to housing 1 by latch screws 11 or other suitable means. With closure 3 in its open position, auxiliary reflector 5, which is held in operative position by spring latch 10, may be swung down to a horizontal position as shown in FIG. 2 to provide ready access to lamp 6 for re-lamping or other maintenance operations.

Main reflector 4, which is typically a one-piece aluminum reflector, comprises four principal reflecting sections R1, R2, R1′ and R2′ arranged symmetrically on opposite sides of vertical median plane M. Rear sections R1 and R1′ are respectively joined to forwardly extending sections R2 and R2′ by flat sections 4*a* and 4*b* respectively. Reflector 4 also has top and bottom walls 4*c*, 4*d* which extend forwardly, diverging somewhat from each other (see FIG. 2). Rim 4*e* extending around the front edges of sections R2, R2′ and top and bottom walls 4*c*, 4*d* defines the front opening of reflector 4.

Auxiliary reflector 5 comprises two sections R3 and R3′ symmetrically arranged on opposite sides of median plane M and respectively facing rear sections R1 and R1′ of main reflector 4.

In a typical arrangement as depicted in FIG. 3, which shows the reflector assembly in horizontal section, gaseous discharge lamp 6 is arranged with its arc tube 6*a* located at point f. Rear reflector sections R1 and R1′ are substantially elliptical in horizontal section with a focus from each co-located at f, and their individual secondary foci located at fs and fs′, respectively, these reflector sections being substantially parabolic in vertical section with the focus of each also at f. As a result of this arrangement, the light from the lamp 6 incident on rear reflector sections R1, R1′ will be reflected therefrom so that the light rays in a horizontal plane will initially converge and cross at the secondary foci fs and fs′ of the respective reflector sections (as indicated at the left side of the FIG. 3 diagram). The light rays reflected from these sections in a vertical plane will be substantially parallel to one another by virtue of their vertical parabolic configuration, it being understood, however, that due to the appreciable length of arc tube 6*a*, the latter light source will not be entirely at the focus f and accordingly the reflected rays will vary somewhat from a parallel condition.

A significant feature of the invention is that the secondary foci fs and fs′ of the elliptical reflector section and the axis of the parabolic reflector section are so arranged that substantially all the light rays reflected from rear reflector sections R1, R1′ will pass through the space between the side edges of auxiliary reflector 5 and the side walls of main reflector 4, thereby avoiding interference from auxiliary reflector 5 with the thus reflected light rays.

As will also be seen from the ray diagram at the left side of the FIG. 3 diagram, the light reflected from rear section R1′ is not intercepted by the outer envelope of lamp 6, thus providing for more efficient utilization and distribution of the light from the lamp, with the added benefit of avoiding overheating of the lamp.

Auxiliary reflector 5 is arranged in front of and closely adjacent lamp 6 with its component reflector sections R3 and R3′ extending laterally and symmetrically on opposite sides of vertical median plane M. These reflector sections are substantially straight in vertical section and substantially parabolic in horizontal section, with the focus of each also at f and their axes directed toward the rear reflector sections R1 and R1′ which they respectively face. As depicted by the ray diagrams on the right side of the FIG. 3 diagram, the light in the horizontal plane from lamp 6 incident on auxiliary reflector section R3 is reflected therefrom in substantially parallel rays incident on rear reflector section R1, from which the rays are so reflected that they converge and cross at a small region about the point fas spaced laterally from the side of auxiliary reflector section R3, from which the rays diverge as they pass outwardly through the reflector mouth. As will be understood, the light rays reflected from section R3′ to rear section R1′ and reflected forwardly therefrom will similarly cross at corresponding point fas′ in the horizontal plane. The rays in the vertical plane from the arc will be diverging as they strike and then leave R3 and R3′, but upon being reflected from R1 and R1′ will be re-directed by the concave surfaces of R1 and R1′ (their vertical parabolic sections) to a slightly vertically elongated region about fas and fas′.

While the auxiliary reflector sections R3, R3′ are preferably parabolic in horizontal section, the curvature thereof may be other than parabolic provided the above described results are obtained.

Thus, in accordance with the invention, the position, configuration and dimensions of the parts are such that substantially all the light reflected from the rear reflector sections of main reflector 4 will pass between the side edges of auxiliary reflector 5 and the side walls of main reflector 4.

Front reflector sections R2 and R2′ of main reflector 4 are substantially parabolic in horizontal section and substantially elliptical in vertical section. The focus of the parabolic curvature is also at f and the axis of the latter is directed outwardly of the reflector at a typical angle of about 40° to the vertical median plane M, so that substantially parallel rays are thus directed outwardly from the opposite front sections R2 and R2′. The elliptical curvature of the latter sections is such that one focus is at f and the respective secondary foci (not shown) are located at a substantial distance outside the mouth of the reflector, so that the light passing through the secondary foci thereafter spreads in a relatively narrow beam in a vertical plane into the desired area of the illumination pattern.

In an optimum reflecting system, as indicated in FIG. 3, the horizontal spread of light emanating from the fixture after reflection only by rear reflector sections R1 and R1′ is in the range of about +20° to −48° relative to the vertical median plane, the horizontal spread of light produced after reflection by auxiliary reflector 5 and rear reflector sections R1 and R1′ is in the range of about +10° to −30°, and both the horizontally parallel beams emanating from front reflector sections R2 and R2′ are directed at an angle of about 40°, as indicated previously.

A sample arrangement of the type described produced a light beam of substantial uniformity over a horizontal angle of about 100° with a vertical angular spread of about 30°.

In accordance with another significant feature of the invention, auxiliary reflector 5 is made sufficiently wide to intersect a line C tangent to reflector rim 4*e* and the arc tube of lamp 6, so as to cut off the direct view of the light source by an observer.

The top and bottom walls 4*c*, 4*d* of main reflector 4 have no significant reflecting function in the described system, particularly since little light emanates directly from the top and bottom ends of lamp 6.

There is thus provided by the described invention a luminaire which is adapted to be mounted at relatively low heights adjacent such work areas as an automobile assembly line and which provides relatively uniform light distribution with substantial light intensity on the work area while avoiding undue glare or uncomfortable brightness in the eyes of an observer even with the use of a high intensity discharge lamp in the luminaire, and which reduces shadows on the work area due to the worker being positioned between the work and the luminaire. Illumination from each of the described focal regions and reflecting areas which are spread within the fixture pass on either side of the worker to fall on the task. Because of these beam spreads, that task area is also illuminated without shadows from adjacent fixtures.

The lighting efficiency is further enhanced by virtue of substantially all the light emanating from the reflector system striking the transparent housing closure at relatively high incident angles, thereby minimizing internal reflection losses.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A luminaire comprising, in combination, a housing having a front opening, a concave main reflector mounted within said housing facing said front opening, said main reflector comprising a pair of curved rear sections arranged on opposite sides of a vertical median plane intersecting said main reflector and a pair of forward reflector sections extending forwardly from said rear sections and defining a reflector opening, an auxiliary reflector interposed between said main reflector and said reflector opening and comprising a pair of reflector sections arranged on opposite sides of said vertical median plane respectively facing said pair of curved rear sections of said main reflector and having opposite lateral edges spaced from said forward reflector sections, and means for mounting a light source substantially in said plane in the space between said rear and auxiliary reflector sections, so that light rays from the light source incident on said auxiliary reflector are redirected thereby to said curved rear sections of said main reflector for reflection therefrom outwardly through said front housing opening on opposite sides of said vertical median plane, the arrangement of said rear reflector sections and said auxiliary reflector sections relative to the light source being such that light rays reflected forwardly from said rear reflector sections pass substantially entirely through the space between said auxiliary reflector sections and said forward reflector sections without additional reflection.

2. A luminaire as defined in claim 1, said rear sections being substantially elliptical in horizontal section and substantially parabolic in vertical section.

3. A luminaire as defined in claim 2, said auxiliary reflector sections being substantially parabolic in horizontal section.

4. A luminaire as defined in claim 3, said forward reflector sections being substantially parabolic in horizontal section and substantially elliptical in vertical section.

5. A luminaire as defined in claim 1, said main reflector having a rim defining said reflector opening, said auxiliary reflector having opposite lateral edges intersecting a line connecting said rim and the light source so as to block direct view of the light source by an observer.

6. A luminaire comprising, in combination, a housing having a front opening, a concave main reflector mounted within said housing facing said front opening, said main reflector comprising a pair of curved rear sections arranged on opposite sides of a vertical median plane intersecting said main reflector and a pair of forward reflector sections extending forwardly from said rear sections and defining a reflector opening, an auxiliary reflector interposed between said main reflector and said reflector opening and comprising a pair of reflector sections arranged on opposite sides of said vertical median plane respectively facing said pair of curved rear sections of said main reflector and having opposite lateral edges spaced from said forward reflector sections, and means for mounting a light source substantially in said plane in the space between said rear and auxiliary reflector sections, so that light rays from the light source incident on said auxiliary reflector are redirected thereby to said curved rear sections of said main reflector for reflection therefrom outwardly through said front housing opening on opposite sides of said vertical median plane, said auxiliary reflector being hingedly mounted on said main reflector for movement between an operative position opposite said rear reflector sections and an open position away from said rear reflector sections.

7. A luminaire as defined in claim 6, and a transparent closure mounted on said housing for movement between a closed and an open position.

* * * * *